US011572614B2

(12) United States Patent
Sakamoto et al.

(10) Patent No.: US 11,572,614 B2
(45) Date of Patent: Feb. 7, 2023

(54) MULTI-CHAMBER HEAT TREATMENT DEVICE

(71) Applicants: IHI CORPORATION, Tokyo (JP); IHI MACHINERY AND FURNACE CO., LTD., Tokyo (JP)

(72) Inventors: Osamu Sakamoto, Tokyo (JP); Ichiro Nakamoto, Tokyo (JP); Takuma Yoshida, Tokyo (JP)

(73) Assignees: IHI CORPORATION, Tokyo (JP); IHI MACHINERY AND FURNACE CO., LTD., Tokyo (JP)

( * ) Notice: Subject to any disclaimer, the term of this patent is extended or adjusted under 35 U.S.C. 154(b) by 555 days.

(21) Appl. No.: 16/698,231

(22) Filed: Nov. 27, 2019

(65) Prior Publication Data

US 2020/0095667 A1 Mar. 26, 2020

Related U.S. Application Data

(63) Continuation of application No. PCT/JP2018/020400, filed on May 28, 2018.

(30) Foreign Application Priority Data

May 29, 2017 (JP) ..... JP2017-105562

(51) Int. Cl.
*C23C 8/20* (2006.01)
*C23C 8/02* (2006.01)

(52) U.S. Cl.
CPC . *C23C 8/20* (2013.01); *C23C 8/02* (2013.01)

(58) Field of Classification Search
None
See application file for complete search history.

(56) References Cited

U.S. PATENT DOCUMENTS

| | | | | |
|---|---|---|---|---|
| 5,354,038 | A * | 10/1994 | Crafton | B22C 5/085 164/404 |
| 5,722,825 | A | 3/1998 | Edenhofer | |
| 5,868,871 | A | 2/1999 | Yokose et al. | |
| 6,149,860 | A | 11/2000 | Furukawa et al. | |
| 2008/0258360 | A1 | 10/2008 | Tanaka et al. | |
| 2014/0097174 | A1 * | 4/2014 | Katsumata | F27B 5/06 219/424 |

(Continued)

FOREIGN PATENT DOCUMENTS

| | | | |
|---|---|---|---|
| CN | 101245440 | A | 8/2008 |
| CN | 106048161 | A | 10/2016 |

(Continued)

*Primary Examiner* — Shamim Ahmed
*Assistant Examiner* — Bradford M Gates
(74) *Attorney, Agent, or Firm* — Rothwell, Figg, Ernst & Manbeck, P.C.

(57) ABSTRACT

The multi-chamber heat treatment device includes intermediate conveyors connected together, each treatment conveyor of the intermediate conveyors is attached with a treater that applies predetermined heat treatment to a treatment object and conveys the treatment object to the treater, and each treater is either one of a main treater that applies main treatment to the treatment object, a preheater that applies preheating treatment to the treatment object before the main treatment, and a cooler that applies cooling treatment to the treatment object after the main treatment.

7 Claims, 6 Drawing Sheets

(56) References Cited

U.S. PATENT DOCUMENTS

| | | | | |
|---|---|---|---|---|
| 2015/0275325 | A1* | 10/2015 | Tseng | F27B 9/10<br>118/712 |
| 2016/0223259 | A1 | 8/2016 | Korecki et al. | |

FOREIGN PATENT DOCUMENTS

| | | | |
|---|---|---|---|
| JP | 08-178535 | A | 7/1996 |
| JP | 8-285462 | A | 11/1996 |
| JP | 09-222282 | A | 8/1997 |
| JP | 10-53809 | A | 2/1998 |
| JP | 11-29821 | A | 2/1999 |
| JP | 2004-037077 | A | 2/2004 |
| JP | 2005-009702 | A | 1/2005 |
| JP | 2007-224424 | A | 9/2007 |
| JP | 2010-266176 | A | 11/2010 |
| JP | 2014-051695 | A | 3/2014 |
| JP | 2018-044688 | A | 3/2018 |

* cited by examiner

MULTI-CHAMBER HEAT TREATMENT DEVICE

CROSS-REFERENCE TO RELATED APPLICATIONS

This application is a Continuation Application based on International Application No. PCT/JP2018/020400, filed May 28, 2018, which claims priority on Japanese Patent Application No. 2017-105562, filed May 29, 2017, the contents of which are incorporated herein by reference.

TECHNICAL FIELD

The present disclosure relates to a multi-chamber heat treatment device.

BACKGROUND

Patent Document 1 shown below discloses a multi-chamber heat treatment device in which a cooling chamber that applies cooling treatment to a treatment object and three heating chambers that apply heating treatment to the treatment object are connected via an intermediate conveyance chamber. In the multi-chamber heat treatment device, the three heating chambers are provided on the upper side of the intermediate conveyance chamber, the cooling chamber is provided on the lower side of the intermediate conveyance chamber, and thereby the treatment object is conveyed to the cooling chamber or each heating chamber via the intermediate conveyance chamber.

DOCUMENT OF RELATED ART

Patent Document

[Patent Document 1] Japanese Unexamined Patent Application, First Publication No. 2014-051695

SUMMARY

Technical Problem

Incidentally, the cooling chamber or each heating chamber described above is a treatment chamber that applies, to the treatment object, the cooling treatment or the heating treatment, and depending on the required performance of the heat treatment to be applied to the treatment object, one cooling chamber and three heating chambers may not be enough, and more treatment chambers may be required. With respect to such a request, in the multi-chamber heat treatment device described above, the number of the treatment chambers is limited, and it may be difficult to provide the treatment chambers in a number corresponding to the request.

The present disclosure is made in view of the above-described circumstances, and an object thereof is to provide a multi-chamber heat treatment device that allows treatment chambers to be easily provided in a required number.

Solution to Problem

In order to obtain the above object, a first aspect of the present disclosure is a multi-chamber heat treatment device including intermediate conveyors connected together, wherein each treatment conveyor of the intermediate conveyors is attached with a treater that applies predetermined heat treatment to a treatment object and conveys the treatment object to the treater, and wherein each treater is either one of a main treater that applies main treatment to the treatment object, a preheater that applies preheating treatment to the treatment object before the main treatment, and a cooler that applies cooling treatment to the treatment object after the main treatment.

A second aspect of the present disclosure is that in the multi-chamber heat treatment device of the first aspect, the intermediate conveyor is attached with a plurality of the preheaters, which are disposed such that travel distances or travel periods of time of the treatment object to the main treater in the intermediate conveyors are equal to each other.

A third aspect of the present disclosure is that in the multi-chamber heat treatment device of the first or second aspect, the intermediate conveyor is attached with a plurality of the main treaters, which are disposed such that travel distances or travel periods of time of the treatment object to the cooler in the intermediate conveyors are equal to each other.

A fourth aspect of the present disclosure is that in the multi-chamber heat treatment device of any one of the first to third aspects, the intermediate conveyor is attached with a heat equalizer that applies heat-equalizing treatment to the treatment object after the preheating treatment.

A fifth aspect of the present disclosure is that in the multi-chamber heat treatment device of any one of the first to fourth aspects, the intermediate conveyor is provided with a plurality of loading ports and/or a plurality of unloading ports for the treatment object.

A sixth aspect of the present disclosure is that in the multi-chamber heat treatment device of any one of the first to fifth aspects, the treater is attachable and detachable to and from the intermediate conveyor.

A seventh aspect of the present disclosure is that in the multi-chamber heat treatment device of any one of the first to sixth aspects, the treater is interchangeable with a different kind of treater.

A eighth aspect of the present disclosure is that in the multi-chamber heat treatment device of any one of the first to seventh aspects, in a conveyance pathway to the treater in the intermediate conveyor, another treater is disposed, and the intermediate conveyor is configured to convey the treatment object to each of the treater and the other treater via the conveyance pathway.

A ninth aspect of the present disclosure is that in the multi-chamber heat treatment device of any one of the first to eighth aspects, the intermediate conveyors are linearly disposed in plan view.

Effects

According to the present disclosure, it is possible to provide a multi-chamber heat treatment device that allows treatment chambers to be easily provided in a required number.

DESCRIPTION OF EMBODIMENTS

Hereinafter, an embodiment of the present disclosure will be described with reference to the drawings.

Figure 1:
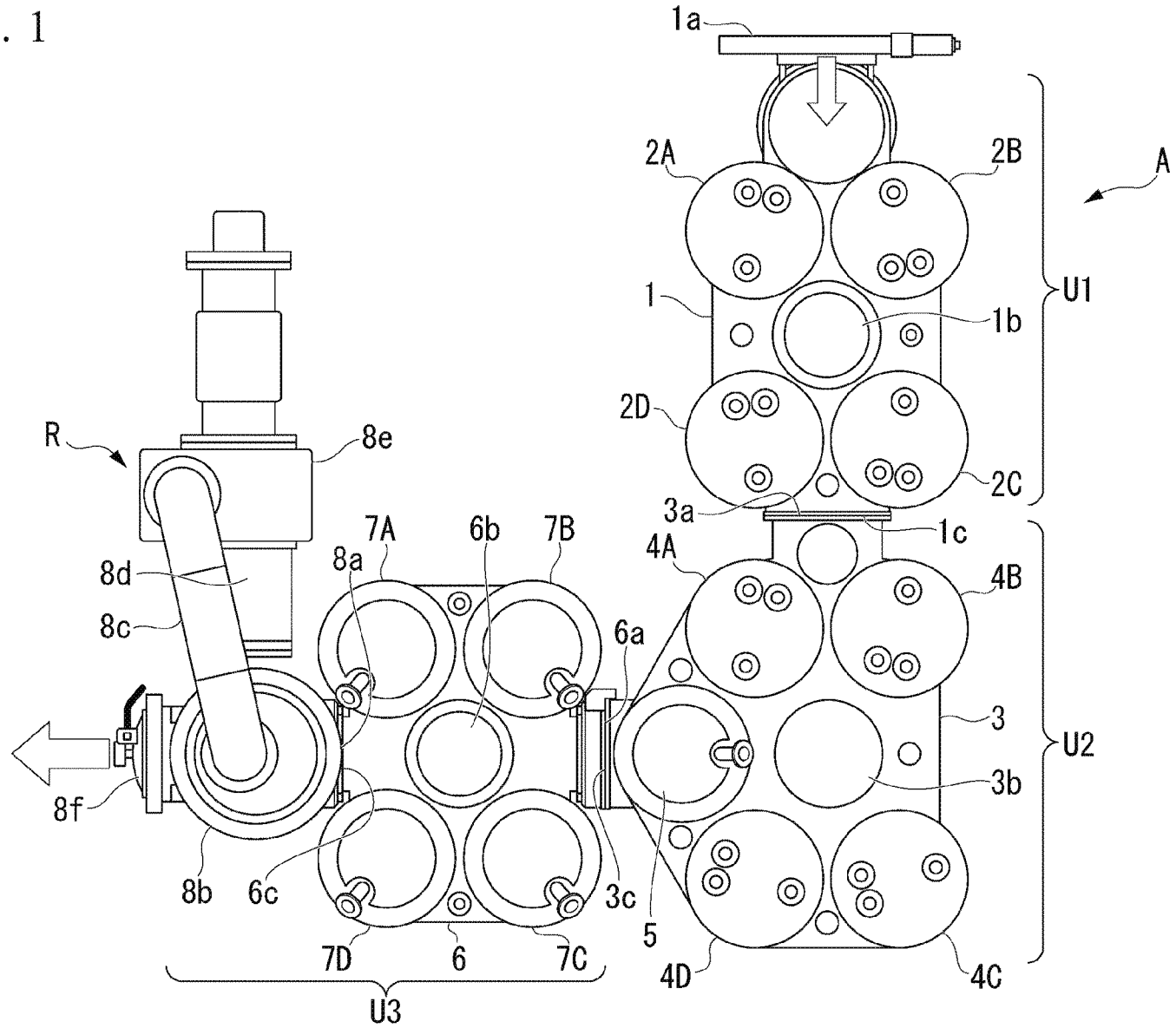
FIG. 1 is a plan view of a multi-chamber heat treatment device of an embodiment of the present disclosure.
Figure 2:
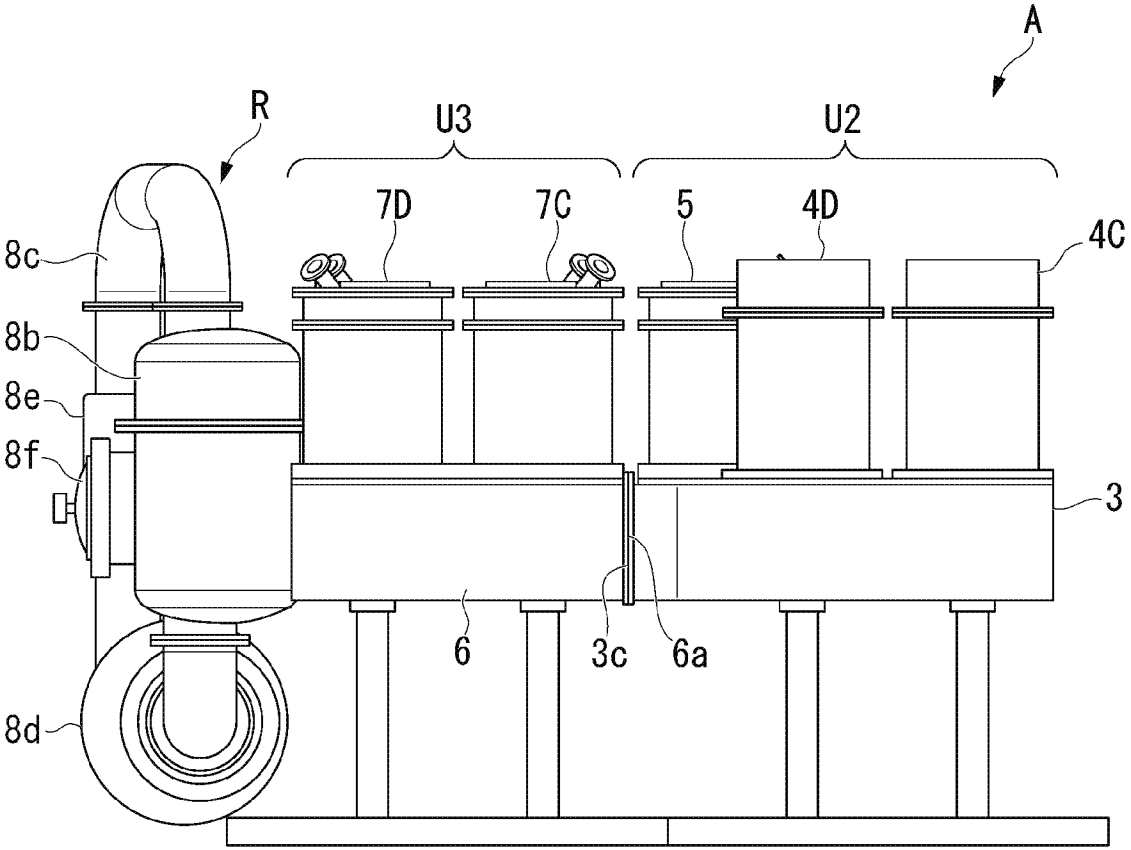
FIG. 2 is a side view of the multi-chamber heat treatment device of the embodiment of the present disclosure.

A multi-chamber heat treatment device A of this embodiment is a heat treatment device that regards various kinds of metal article X as a treatment object and applies preheating treatment, carburizing treatment (main treatment) and cooling treatment to the metal article X, thereby forming a predetermined carburized layer on a surface of the metal article X (the treatment object). As shown in FIGS. 1 and 2, in the multi-chamber heat treatment device A, three units, namely a first unit U1, a second unit U2 and a third unit U3, are connected in series, and a gas cooler R is connected to the last third unit U3. Moreover, in the following description, "plan view" denotes a view of the multi-chamber heat treatment device A or the like viewed in the vertical direction.

The first unit U1 includes a first intermediate conveyer 1 and four preheaters 2A to 2D. The second unit U2 includes a second intermediate conveyer 3, four preheaters 4A to 4D and a heat equalizer 5. The third unit U3 includes a third intermediate conveyor 6 and four carburizers 7A to 7D.

The first intermediate conveyor 1, the second intermediate conveyor 3 and the third intermediate conveyor 6 are configured to convey the metal article X to the preheaters 2A to 2D and 4A to 4D, the heat equalizer 5, and the carburizers 7A to 7D and correspond to the intermediate conveyer of the present disclosure. In addition, the eight preheaters 2A to 2D and 4A to 4D, the heat equalizer 5 and the four carburizers 7A to 7D are configured to apply predetermined heat treatments to the metal article X and correspond to the treater (treatment device) of the present disclosure. Furthermore, the four carburizers 7A to 7D correspond to the main treater (main treatment device) of the present disclosure.

The first intermediate conveyor 1 of the first unit U1 is a box-shaped hollow body internally provided with a first conveyance chamber and includes a loading port 1*a*, a first relay station 1*b* and an unloading port 1*c*. The loading port 1*a* is provided on one lateral surface of the first intermediate conveyor 1 (the first conveyance chamber) and is an opening for carrying the metal article X (the treatment object) into the first conveyance chamber. In addition, the loading port 1*a* is provided with a flange (flat plate-shaped member) having a predetermined size, and the flange is provided with an open/close shutter for opening and closing the loading port 1*a*.

The first relay station 1*b* is a stand-by station provided approximately at the center (approximately the center in plan view) of the first intermediate conveyor 1 (the first conveyance chamber). That is, the first relay station 1*b* is a place through which the metal article X always passes when the metal article X is conveyed in the first intermediate conveyor 1 (the first conveyance chamber). The unloading port 1*c* is provided so as to face the loading port 1*a* and is an opening for carrying the metal article X out of the first conveyance chamber. The unloading port 1*c* is also provided with a flange (flat plate-shaped member) having a predetermined size.

The first intermediate conveyor 1 includes a horizontal conveyor that moves the metal article X horizontally in the first conveyance chamber and a lifter that moves the metal article X up and down therein, although not show. The first intermediate conveyor 1 operates the horizontal conveyor and the lifter to convey the metal article X, which has been taken from the loading port 1*a* into the first conveyance chamber, via the first relay station 1*b* to the preheaters 2A to 2D and the unloading port 1*c*.

Each of the four preheaters 2A to 2D is a hollow substantially cylindrical body internally provided with a preheating chamber and is mounted on the top of the first intermediate conveyor 1 in a posture in which the central axis thereof is parallel with the vertical direction. The preheaters 2A to 2D are arranged such that the distances from the first relay station 1*b* of the first intermediate conveyor 1 to the preheaters 2A to 2D are equal to each other, as the positional relationships in a horizontal plane.

The preheaters 2A to 2D are detachably attached to the first intermediate conveyor 1 by using fasteners such as bolts. Each of the preheaters 2A to 2D includes an electric heater and preheats the metal article X up to a predetermined temperature before the carburizing treatment (the main treatment) to be performed in each of the carburizers 7A to 7D.

The second intermediate conveyer 3 of the second unit U2 is a box-shaped hollow body internally provided with a second conveyance chamber and includes a loading port 3*a*, a second relay station 3*b* and an unloading port 3*c*. The loading port 3*a* is provided on one lateral surface of the second intermediate conveyor 3 (the second conveyance chamber) and is an opening for carrying the metal article X (the treatment object) into the second conveyance chamber. Similar to the unloading port 1*c* of the first intermediate conveyor 1 described above, the loading port 3*a* is provided with a flange (flat plate-shaped member) having a predetermined size.

The second unit U2 is connected to the first unit U1 by fastening the flange provided at the loading port 3*a* of the second intermediate conveyor 3 to the flange provided at the unloading port 1*c* of the first intermediate conveyor 1 with fasteners such as bolts. The second relay station 3*b* is a stand-by station provided approximately at the center (approximately the center in plan view) of the second conveyance chamber. The second relay station 3*b* is a place through which the metal article X always passes when the metal article X is conveyed in the second intermediate conveyor 3 (the second conveyance chamber). The unloading port 3*c* is provided in a posture orthogonal to the loading port 3*a* and is an opening for carrying the metal article X out of the second conveyance chamber. That is, the opening direction (the central axis direction) of the loading port 3*a* and the opening direction (the central axis direction) of the unloading port 3*c* are orthogonal to each other. The unloading plate 3*c* is provided with a flange (flat plate-shaped member) having a predetermined size.

The second intermediate conveyor 3 includes a horizontal conveyor that moves the metal article X horizontally in the second conveyance chamber and a lifter that moves the metal article X up and down therein, although not shown. The second intermediate conveyor 3 operates the horizontal conveyor and the lifter to convey the metal article X, which has been taken from the loading port 3*a* into the second conveyance chamber, via the second relay station 3*b* to the preheaters 4A to 4D and the unloading port 3*c*.

Each of the four preheaters 4A to 4D is a hollow substantially cylindrical body internally provided with a preheating chamber and is mounted on the top of the second intermediate conveyor 3 (the second conveyance chamber) in a posture in which the central axis thereof is parallel with the vertical direction. The preheaters 4A to 4D are arranged such that the distances from the second relay station 3*b* of the second intermediate conveyer 3 to the preheaters 4A to 4D are equal to each other, as the positional relationships in a horizontal plane.

The preheaters 4A to 4D are detachably attached to the second intermediate conveyor 3 by using fasteners such as bolts. Each of the preheaters 4A to 4D includes an electric heater and preheats the metal article X up to a predetermined temperature before the carburizing treatment (the main treatment) to be performed in each of the carburizers 7A to 7D.

The heat equalizer 5 is a hollow substantially cylindrical body internally provided with a heat-equalizing chamber and is mounted on the top of the second intermediate conveyor 3 in a posture in which the central axis thereof is parallel with the vertical direction. The heat equalizer 5 is detachably attached to the second intermediate conveyor 3 by using fasteners such as bolts. The heat equalizer 5 applies heat-equalizing treatment to the metal article X by accommodating the metal articles X, which has been preheated by the preheaters 2A to 2D and 4A to 4D, for a predetermined period of time. Moreover, the heat equalizer 5 and the above-described preheaters 2A to 2D and 4A to 4D are preceding treaters that apply preceding treatment (preheating treatment and heat-equalizing treatment) to the metal article X before the carburizing treatment (the main treatment) in the carburizers 7A to 7D.

The third intermediate conveyor 6 of the third unit U3 is a box-shaped hollow body internally provided with a third conveyance chamber and includes a loading port 6*a*, a third relay station 6*b* and an unloading port 6*c*. The loading port 6*a* is provided on one lateral surface of the third intermediate conveyor 6 (the third conveyance chamber) and is an opening for carrying the metal article X into the second conveyance chamber. Similar to the unloading port 3*c* of the second intermediate conveyer 3 described above, the loading port 6*a* is provided with a flange (flat plate-shaped member) having a predetermined size.

The third unit U3 is connected to the second unit U2 by fastening the flange provided at the loading port 6*a* of the third intermediate conveyor 6 to the flange provided at the unloading port 3*c* of the second intermediate conveyor 3 with fasteners such as bolts. The third relay station 6*b* is a stand-by station for the metal article X, which is provided approximately at the center (approximately the center in plan view) of the third conveyance chamber. The third relay station 6*b* is a place through which the metal article X always passes when the metal article X is conveyed in the third intermediate conveyor 6 (the third conveyance chamber). The unloading port 6*c* is provided so as to face the loading port 6*a* and is an opening for carrying the metal article X out of the third conveyance chamber. The unloading port 6*c* is also provided with a flange (flat plate-shaped member) having a predetermined size.

The third intermediate conveyor 6 includes a horizontal conveyor that moves the metal article X horizontally in the third conveyance chamber and a lifter that moves the metal article X up and down therein, although not shown. The third intermediate conveyor 6 operates the horizontal conveyor and the lifter to convey the metal article X, which has been taken from the loading port 6*a* into the third conveyor chamber, via the third relay station 6*b* to the carburizers 7A to 7D and the unloading port 6*c*.

Each of the four carburizers 7A to 7D is a hollow substantially cylindrical body internally provided with a carburizing chamber and is a treater mounted on the top of the third intermediate conveyor 6 in a posture in which the central axis thereof is parallel with the vertical direction. The carburizers 7A to 7D are arranged such that the distances from the third relay station 6*b* of the third intermediate conveyor 6 to the carburizers 7A to 7D are equal to each other, as the positional relationships in a horizontal plane.

Each of the carburizers 7A to 7D is detachably attached to the third intermediate conveyor 6 by using fasteners such as bolts. Each of the carburizers 7A to 7D includes an electric heater and a carburizing gas supply device and holds the metal article X accommodated in the carburizing chamber under a heating environment and a carburizing gas atmosphere, thereby applying predetermined carburizing treatment to the metal article X. That is, each of the carburizers 7A to 7D applies the carburizing treatment as the main treatment to the metal article X having been subjected to the preheating treatment and the heat-equalizing treatment as the preceding treatment.

The gas cooler R is a treater connected to the third unit U3 and includes a loading port 8*a*, a cooling chamber 8*b*, a circulation chamber 8*c*, a heat exchanger 8*d*, a circulator 8*e* and an unloading port 8*f*. The loading port 8*a* is an opening for carrying the metal article X into the cooling chamber 8*b* and is provided with a flange (flat plate-shaped member) having a predetermined size. The loading port 8*a* is connected to the unloading port 6*c* of the third intermediate conveyor 6 by fastening the flanges with fasteners such as bolts. That is, the gas cooler R is joined with the third unit U3 by connecting the loading port 8*a* to the unloading port 6*c* of the third intermediate conveyor 6.

The cooling chamber 8*b* is a hollow substantially cylindrical body internally provided with a cooling chamber and applies cooling treatment to the metal article X that has been subjected to the carburizing treatment in the carburizers 7A to 7D. The cooling chamber 8*b* cools the metal article X by spraying cooling gas from, for example, above onto the metal article X accommodated in the cooling chamber. The circulation chamber 8*c* is a tubular member having one end connected to the upper end of the cooling chamber 8*b* and another end connected to the lower end of the cooling chamber 8*b*. The circulation chamber 8*c* supplies the cooling gas into the cooling chamber 8*b* from above and collects the cooling gas (heated cooling gas heated by the metal article X), which has contributed to the cooling for the metal article X, from below the cooling chamber 8*b*.

The heat exchanger 8*d* is provided in an intermediate portion of the circulation chamber 8*c* and cools the heated cooling gas by indirect heat exchange between the heated cooling gas and a predetermined refrigerant. The circulator 8*e* is a motive power source for circulating the cooling gas through the circulation chamber 8*c* and includes a fan that blows the cooling gas, an electric motor that drives the fan, and the like. The unloading port 8*f* is disposed to face the loading port 8*a* in the cooling chamber 8*b* and is an opening for taking out the metal article X in the cooling chamber to the outside. The unloading port 8*f* is provided with an open/close door, and the metal article X in the cooling chamber is taken out by opening the open/close door.

Figure 3:
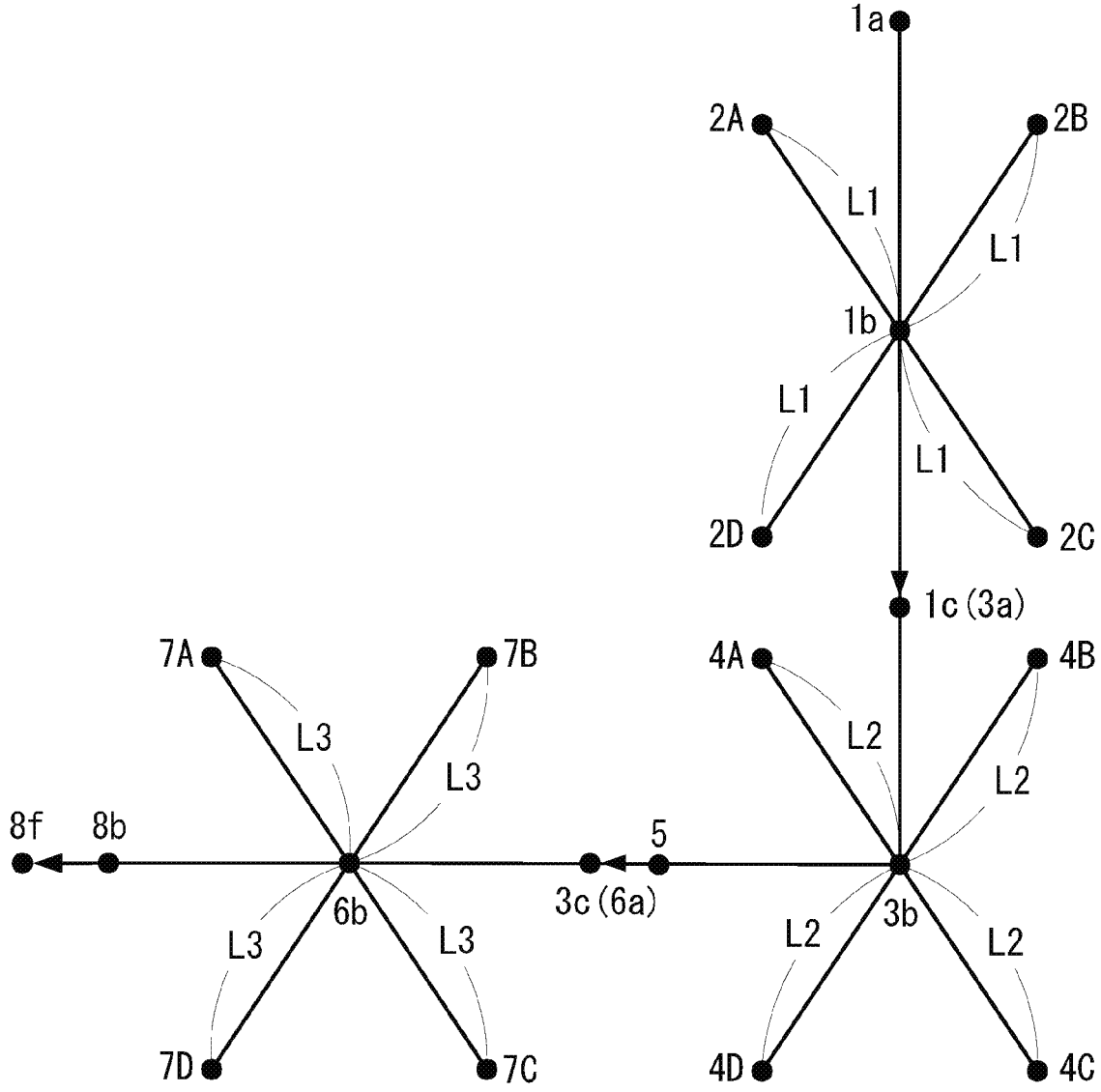
FIG. 3 is a schematic diagram showing positional relationships between and conveyance pathways of devices in a horizontal plane of the multi-chamber heat treatment device of the embodiment of the present disclosure.

FIG. 3 shows the positional relationships between and the conveyance pathways of devices of the multi-chamber heat treatment device A having the above configuration, in a horizontal plane. Black spots indicate the positions of devices and are attached with the reference signs corresponding to the devices shown in FIG. 1. As shown in FIG. 3, the positions of the four preheaters 2A to 2D (the preheating chambers) in the first unit U1 are set such that the distances from the first relay station 1*b* of the first intermediate conveyor 1 to the preheaters 2A to 2D are equal to a distance L1.

The positions of the four preheaters 4A to 4D (the preheating chambers) in the second unit U2 are set such that the distances from the second relay station 3*b* of the second intermediate conveyor 3 to the preheaters 4A to 4D are equal to a distance L2. The positions of the four carburizers 7A to 7D (the carburizing chambers) in the third unit U3 are set such that the distances from the third relay station 6*b* of the third intermediate conveyor 6 to the carburizers 7A to 7D are equal to a distance L3.

In addition, the multi-chamber heat treatment device A of this embodiment includes a controller (not shown) and applies desired heat treatment to the metal article X by being comprehensively controlled by the controller. The controller is provided with a control panel using a touch panel or the like and is configured to appropriately set conditions relating to functions of various devices of the multi-chamber heat treatment device A, for example, preheating conditions such as a preheating temperature and a preheating period of time in each of the preheaters 2A to 2D and 4A to 4D, carburizing conditions such as a carburizing temperature and a carburizing period of time in each of the carburizers 7A to 7D, and cooling conditions such as a cooling temperature and a cooling period of time in the gas cooler R.

Next, the operation of the multi-chamber heat treatment device A having the above configuration will be described.

In a case where the heat treatment is applied to the metal article X using the multi-chamber heat treatment device A, the metal article X is carried into the first conveyance chamber from the loading port 1*a* of the first intermediate conveyor 1 by a transferer (not shown). The metal article X is once conveyed by the first intermediate conveyor 1 to the first relay station 1*b* and is further conveyed to an empty preheater, namely, the preheating chamber of one of the four preheaters 2A to 2D.

Then, the metal article X accommodated in the empty preheating chamber is preheated to a predetermined preheating target temperature by being heated in the preheating chamber. That is, the four preheaters 2A to 2D attached to the first intermediate conveyor 1 simultaneously preheat four (four groups) metal articles X in maximum in parallel.

In addition, when the metal article X is accommodated in each of the four preheaters 2A to 2D, that is, when the fifth to eighth metal articles X are taken in the first conveyance chamber from the loading port 1*a* of the first intermediate conveyor 1, these metal articles X are conveyed from the loading port 1*a* through the first relay station 1*b* and through the unloading port 1*c* of the first intermediate conveyor 1 into the second conveyance chamber. Then, these metal articles X are sequentially conveyed to the empty preheating chamber among the four preheaters 4A to 4D attached to the second intermediate conveyor 3. In this way, the metal articles X accommodated in the four preheaters 4A to 4D are preheated to a predetermined preheating target temperature.

That is, according to the multi-chamber heat treatment device A of this embodiment, eight metal articles X in maximum can be simultaneously subjected to the preheating treatment in parallel. In addition, the number of metal articles X to be simultaneously preheated in parallel can be easily increased by increasing the number of connected units of the first unit U1 and/or the second unit U2, namely, increasing the number of the preheaters 2A to 2D and/or the preheaters 4A to 4D.

Subsequently, when the metal article X is preheated to the preheating target temperature in either one of the four preheaters 2A to 2D, the metal article X is once conveyed by the first intermediate conveyor 1 from the preheating chamber to the first relay station 1*b* of the first conveyance chamber. Then, the metal article X is conveyed via the unloading port 1*c* of the first intermediate conveyor 1 and via the loading port 3*a* of the second intermediate conveyor 3 to the second relay station 3*b*.

Furthermore, the metal article X is conveyed from the second relay station 3*b* to the heat equalizer 5 and is accommodated in the heat-equalizing chamber. Then, the metal article X is equalized in temperature by being left in the heat-equalizing chamber for a predetermined period of time. That is, when the metal article X is left in the heat-equalizing chamber, local unevenness in preheating (preheating unevenness) at the preheating chamber is corrected, resulting in an equal temperature as a whole.

Then, the metal article X that has undergone the heat-equalizing treatment in the heat equalizer 5 (the heat-equalizing chamber) is conveyed from the heat equalizer 5 (the heat-equalizing chamber) via the unloader port 3*c* of the second intermediate conveyor 3 and via the loading port 6*a* of the third intermediate conveyor 6 to the third relay station 6*b*. Then, the metal article X is sequentially conveyed to the empty carburizing chamber, namely, the carburizing chamber of either one of the four carburizers 7A to 7D.

Thus, the metal article X accommodated in each of the carburizers 7A to 7D (the carburizing chambers) is subjected to the carburizing treatment under a heating environment and a carburizing gas atmosphere. That is, carbon atoms are impregnated in the metal article X a predetermined depth from the surface thereof in each of the carburizers 7A to 7D (the carburizing chambers), and a carburized layer is formed in an area close to the surface.

That is, according to the multi-chamber heat treatment device A of this embodiment, it is possible to simultaneously apply the carburizing treatment four metal articles X in maximum in parallel. Moreover, it is possible to easily increase the number of the metal articles X to be simultaneously subjected to the carburizing treatment in parallel by increasing the number of joined units of the third unit U3. For example, when another third unit U3 is provided between the above-described third unit U3 and the gas cooler R, it is possible to increase the number of the metal articles X to be simultaneously subjected to the carburizing treatment to eight.

The metal article X in which the carburizing treatment has been finished in each of the carburizers 7A to 7D (the carburizing chambers) is once conveyed from each of the carburizers 7A to 7D (the carburizing chambers) to the third relay station 6*b* of the third intermediate conveyer 6. Then, the metal article X is conveyed from the third relay station 6*b* via the unloading port 6*c* and via the loading port 8*a* of the gas cooler R to the inside of the cooling chamber 8*b*, namely, the cooling room.

Then, the metal article X accommodated in the cooling chamber 8*b* (the cooling room) is cooled according to a predetermined cooling history by the cooling gas circulating in the cooling chamber 8*b* (the cooling room) and the circulation chamber 8*c*. Then, the metal article X in which the cooling treatment has been finished in the cooling chamber 8*b* (the cooling room) is carried out from the unloading port 8*f* of the cooling chamber 8*b* (the gas cooler 8).

According to the multi-chamber heat treatment device A having the above configuration, since a plurality of preheating chambers and a plurality of carburizing chambers are obtained by connecting the first unit U1, the second unit U2, the third unit U3 and the gas cooler R, it is possible to easily provide the preheating chambers and the carburizing chambers in required numbers.

In addition, in the multi-chamber heat treatment device A of this embodiment, the travel distances or the travel periods of time of the metal article X from the four carburizers 7A to 7D (the carburizing chambers) to the cooling chamber 8*b* (the cooling room) are equal to each other in all of the carburizers 7A to 7D. Even if the metal article X is subjected to the carburizing treatment in any one of the carburizers 7A to 7D (the carburizing chambers), the metal article X is conveyed to the cooling chamber 8*b* (the cooling room) through an equal travel distance or an equal travel period of time and is subjected to the cooling treatment.

That is, in this multi-chamber heat treatment device A, conveyance cooling states during conveyance from the four carburizers 7A to 7D (the carburizing chamber) to the cooling chamber 8*b* (the cooling room) are equal to each other in all of the carburizers 7A to 7D (the carburizing chambers). Thus, according to the multi-chamber heat treatment device A, since the cooling history after the carburizing treatment can be set to be equal, it is possible to form an equal carburized layer on the metal articles X.

In addition, in the multi-chamber heat treatment device A of this embodiment, the travel distances or the travel periods of time of the metal article X from the four preheaters 4A to 4D (the preheating chambers) to the four carburizers 7A to 7D (the carburizing chambers) are equal to each other in all of the preheaters 4A to 4D (the preheating chambers). Even if the metal article X is subjected to the preheating treatment in any one of the preheaters 4A to 4D (the preheating chambers), the metal article X is conveyed to the carburizers 7A to 7D (the carburizing chambers) through an equal travel distance or an equal travel period of time and is subjected to the carburizing treatment.

That is, in this multi-chamber heat treatment device A, conveyance cooling states during conveyance from the four preheaters 4A to 4D (the preheating chambers) to the four carburizers 7A to 7D (the carburizing chambers) are equal to each other in all of the preheaters 4A to 4D (the preheating chambers). Thus, according to the multi-chamber heat treatment device A, since the temperatures (preheating temperatures) of the metal articles X before the carburizing treatment can become equal, it is possible to apply equal carburizing treatment to the metal articles X.

Furthermore, in the multi-chamber heat treatment device A of this embodiment, the travel distances or the travel periods of time of the metal article X from the four preheaters 2A to 2D (the preheating chambers) to the four carburizers 7A to 7D (the carburizing chambers) are equal to each other in all of the preheaters 2A to 2D (the preheating chambers). Even if the metal article X is subjected to the preheating treatment in any one of the preheaters 2A to 2D (the preheating chambers), the metal article X is conveyed to the carburizers 7A to 7D (the carburizing chambers) through an equal travel distance or an equal travel period of time and is subjected to the carburizing treatment.

That is, in this multi-chamber heat treatment device A, conveyance cooling states during conveyance from the four preheaters 2A to 2D (the preheating chambers) to the four carburizers 7A to 7D (the carburizing chambers) are equal to each other in all of the preheaters 2A to 2D (the preheating chambers). Thus, according to the multi-chamber heat treatment device A, since the temperatures (preheating temperatures) of the metal articles X before the carburizing treatment can become equal, it is possible to apply equal carburizing treatment to the metal articles X.

First to third modifications of the above embodiment will be described with reference to FIGS. 4 to 6. In these modifications, the same or equal component as or to that of the above embodiment is attached with an equal reference sign, and the explanation thereof will be simplified or omitted.

First Modification

Figure 4:
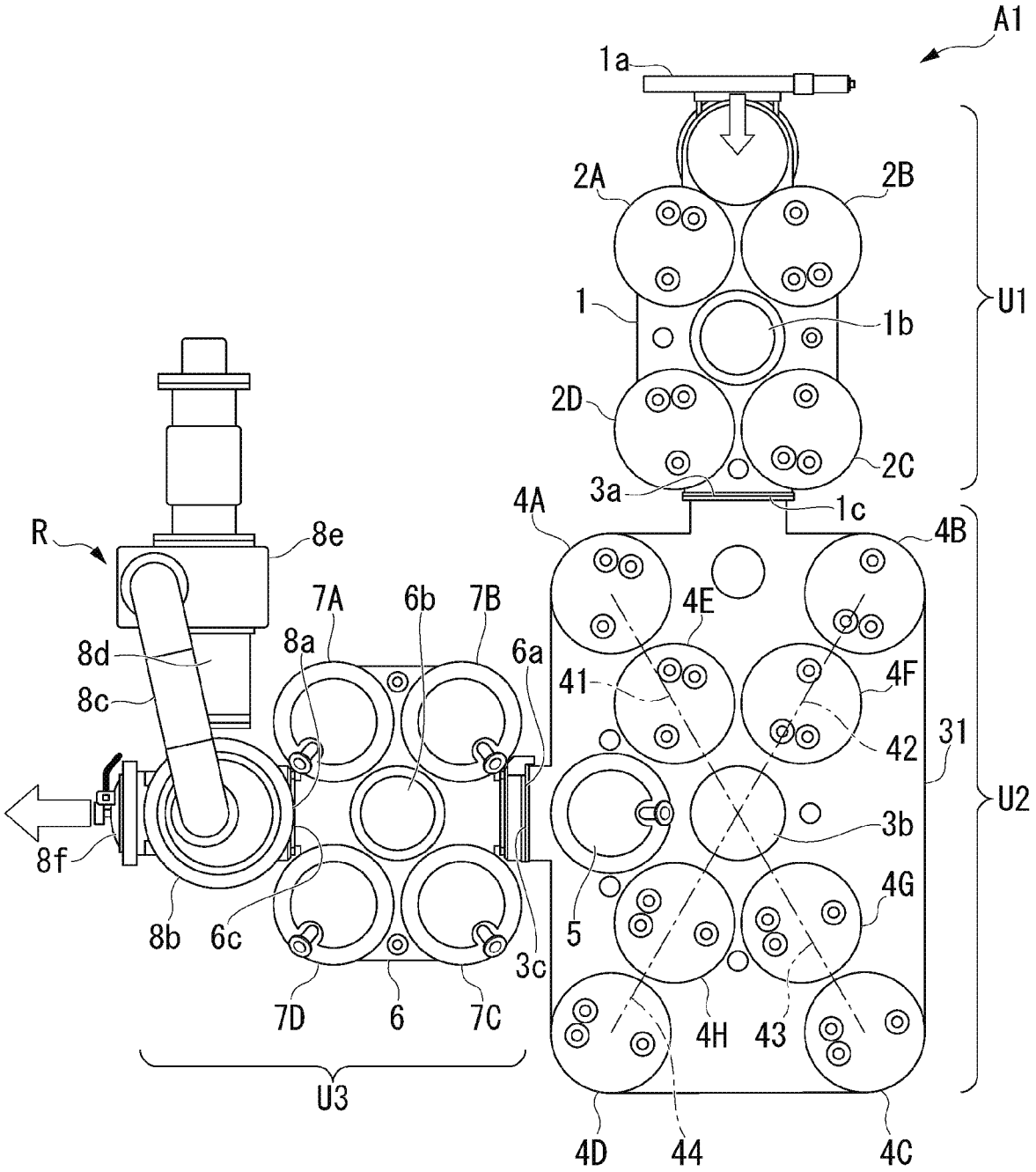
FIG. 4 is a plan view of a multi-chamber heat treatment device of a first modification of the embodiment of the present disclosure.

As shown in FIG. 4, a second unit U2 of a multi-chamber heat treatment device A1 of the first modification includes a second intermediate conveyor 31 instead of the second intermediate conveyor 3 of the above embodiment and further includes eight preheaters 4A to 4H (treaters) and the heat equalizer 5. The second intermediate conveyor 31 is a box-shaped hollow body internally provided with a second conveyance chamber (not shown) and includes the loading port 3*a*, the second relay station 3*b* and the unloading port 3*c* described above.

The four preheaters 4A to 4D are disposed at four corners of the second intermediate conveyor 31 in plan view. In the second intermediate conveyor 31, the second relay station 3*b* and the four preheaters 4A to 4D are joined to each other via four conveyance pathways 41 to 44, respectively. These conveyance pathways 41 to 44 are configured of horizontal conveyors for horizontally moving the metal article X and lifters for moving the metal article X up and down, although not shown. The conveyance pathways 41 to 44 radially and linearly extend from the second relay station 3*b* in plan view.

The four preheaters 4E to 4H are disposed on intermediate portions of the conveyance pathways 41 to 44, respectively. That is, the preheaters 4E to 4H (other treater) are disposed in the conveyance pathways 41 to 44 extending to the preheaters 4A to 4D (treater) of the second intermediate conveyor 31, respectively. The second intermediate conveyor 31 is configured to convey the metal article X to each of the preheaters 4A to 4D and 4E to 4H via the conveyance pathways 41 to 44. For example, the second intermediate conveyor 31 is configured to convey the metal article X to each of the preheater 4A and the preheater 4E via the conveyance pathway 41.

In addition, in the multi-chamber heat treatment device A1 of the first modification, each travel distance of the metal article X from the preheaters 4A to 4D to the carburizers 7A to 7D is greater than each travel distance of the metal article X from the preheaters 4E to 4H to the carburizers 7A to 7D. In order to cause each travel period of time of the metal article X from the preheaters 4A to 4D to the carburizers 7A to 7D to be equal to each travel period of time of the metal article X from the preheaters 4E to 4H to the carburizers 7A to 7D, it is only necessary to cause the traveling speed of the metal article X preheated at the preheaters 4E to 4H to the carburizers 7A to 7D to be less than the traveling speed of the metal article X preheated at the preheaters 4A to 4D to the carburizers 7A to 7D.

When many treaters are arranged such that the distances from the second relay station 3*b* to the treaters are equal in plan view, it is necessary to lengthen the conveyance pathway between the second relay station 3*b* and these treaters, and as a result, the second intermediate conveyor may increase in size. In this modification, two treaters are disposed in one conveyance pathway in plan view, and the metal article X can be conveyed to each of the two treaters via the conveyance pathway, so that the second intermediate conveyer can be limited from increasing in size even if many treaters are disposed.

In the second intermediate conveyor 31, the number of the conveyance pathways may be 1 to 3 or 5 or more, and three or more treaters may be disposed in one conveyance pathway. The types of a plurality of treaters disposed in one conveyance pathway may be different from each other.

Second Modification

Figure 5:
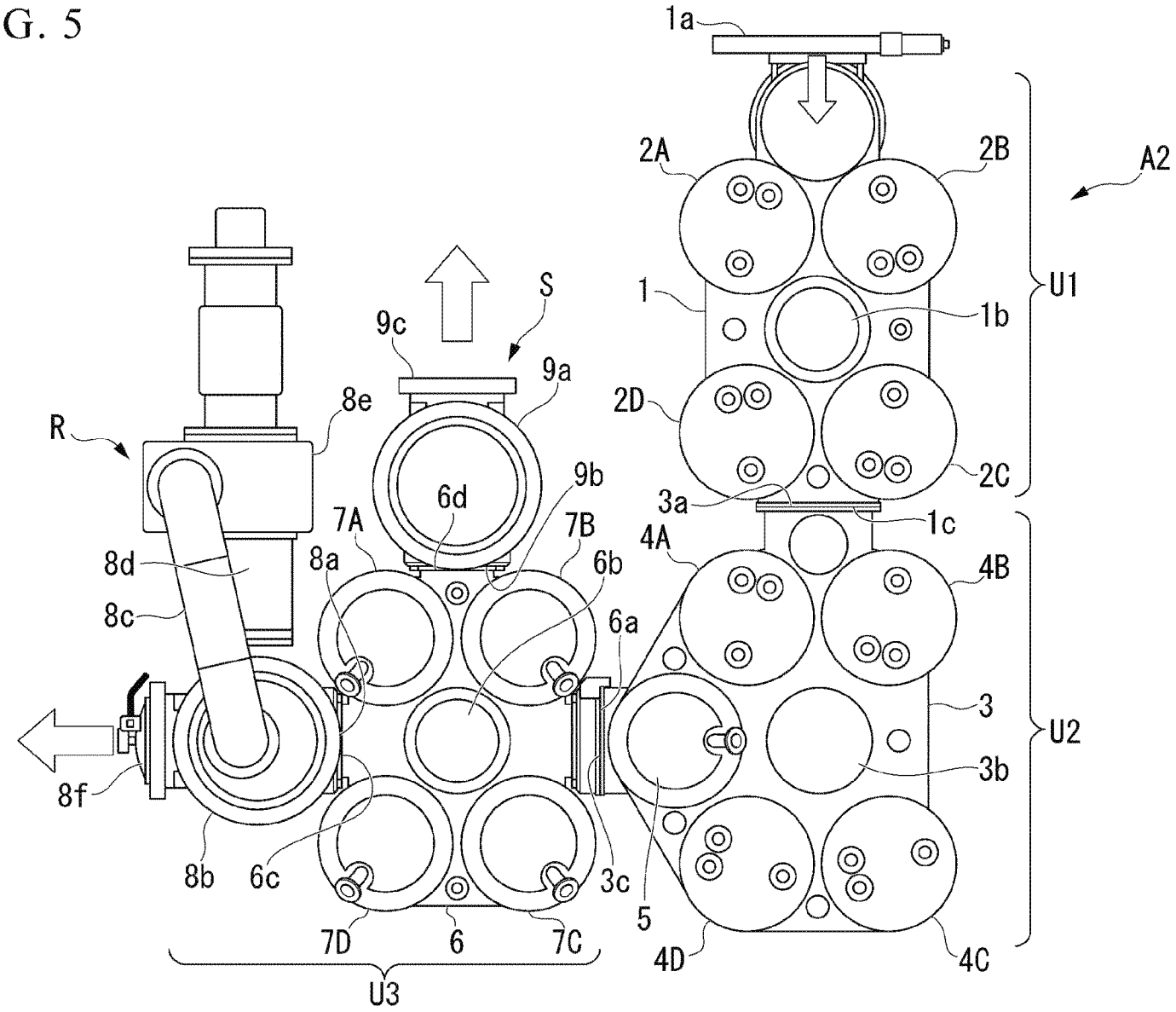
FIG. 5 is a plan view of a multi-chamber heat treatment device of a second modification of the embodiment of the present disclosure.

As shown in FIG. 5, a multi-chamber heat treatment device A2 of the second modification includes, in addition to the configuration that the multi-chamber heat treatment device A of the above embodiment has, a dipping cooler S (treater) attached to the third intermediate conveyor 6 of the third unit U3. The third intermediate conveyor 6 includes a second unloading port 6*d* in addition to the loading port 6*a*, the third relay station 6*b* and the unloading port 6*c* described above. The second unloading port 6*d* is an opening for carrying the metal article X out of the third conveyance chamber of the third intermediate conveyor 6 and is provided with a flange.

The dipping cooler S includes a dipping tank 9*a*, a loading port 9*b* and an unloading port 9*c*. The dipping tank 9*a* is a tank in which a liquid such as oil to be used as a refrigerant is stored, and the metal article X is cooled by dipping the metal article X into the stored liquid. The loading port 9*b* is an opening for carrying the metal article X into the dipping tank 9*a* and is provided with a flange. The loading port 9*b* is connected to the second unloading port 6*d* of the third intermediate conveyor 6 by fastening the flanges with fasteners such as bolts. The unloading port 9*c* is an opening for taking out the metal article X after cooling in the dipping tank 9*a* to the outside. The dipping cooler S may be provided with a conveyer for conveying the metal article X, a lifter for dipping the metal article X into the liquid stored in the dipping tank 9*a* and for lifting the metal article X from the liquid, and the like, although not shown.

The dipping cooler S generally has a higher cooling capacity than the gas cooler R that uses the cooling gas (gas) as a refrigerant. In addition, depending on the type of the metal article X and the cooling conditions, cooling by the dipping cooler S may not be preferable, and cooling by the gas cooler R may be preferable. Since both of the gas cooler R and the dipping cooler S are attached to the third intermediate conveyor 6 of this modification, even if the type of the metal article X or the cooling conditions are changed, an appropriate cooling method depending on the type of the metal article X can be determined without performing the setup change.

Third Modification

Figure 6:
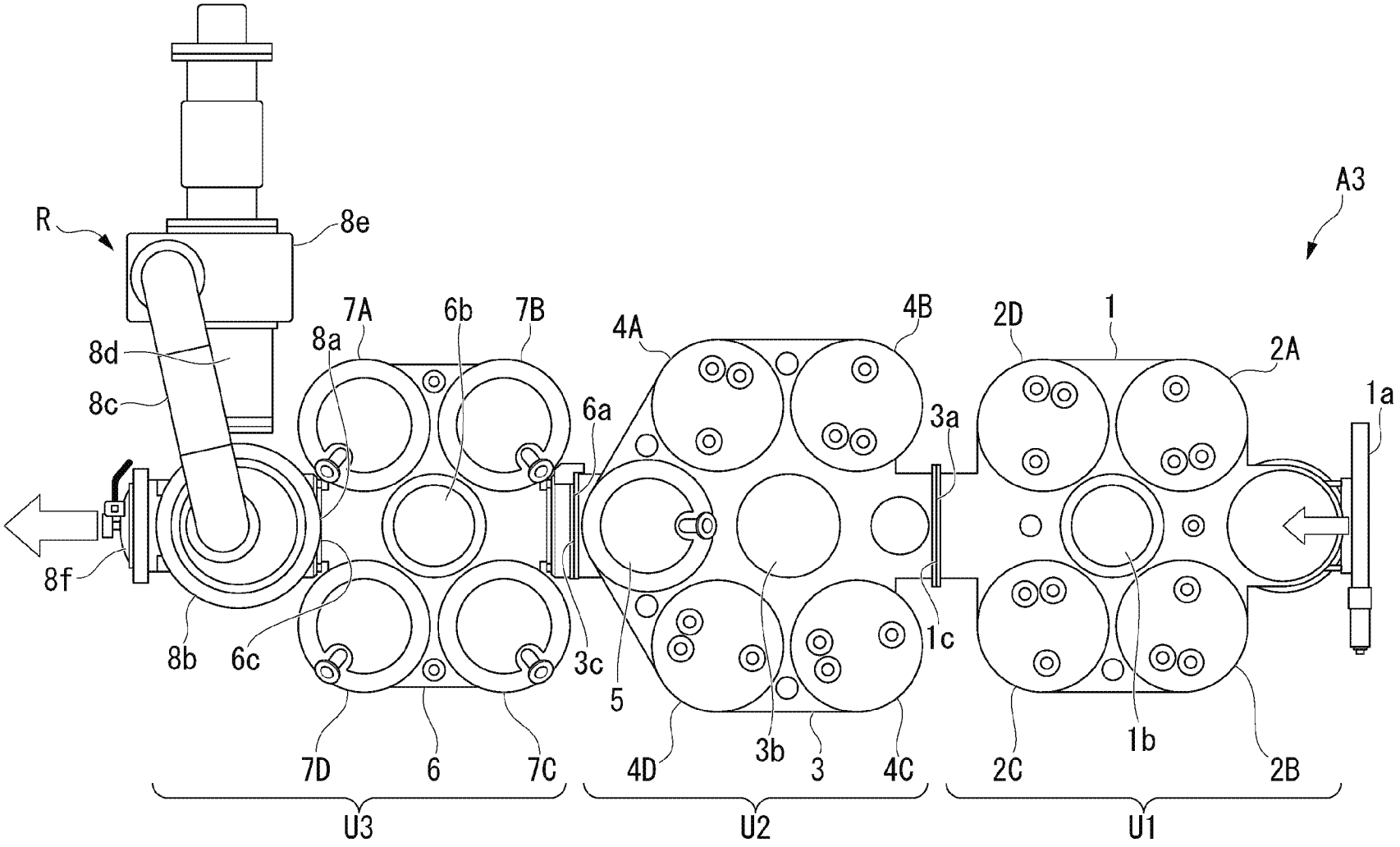
FIG. 6 is a plan view of a multi-chamber heat treatment device of a third modification of the embodiment of the present disclosure.

As shown in FIG. 6, in a multi-chamber heat treatment device A3 of the third modification, the first unit U1, the second unit U2 and the third unit U3 are linearly arranged in plan view. That is, the first intermediate conveyor 1, the second intermediate conveyor 3 and the third intermediate conveyor 6 are linearly arranged in plan view. The loading port 3*a* and the unloading port 3*c* of the second intermediate conveyor 3 of this modification are arranged to face each other.

Since the loading port 3*a* and the unloading port 3*c* of the second intermediate conveyor 3 are disposed to face each other, the conveyance pathway from the loading port 3*a* to the unloading port 3*c* can be made to be linear. Therefore, it is possible to more quickly and smoothly convey the metal article X than the above embodiment, by causing the metal article X to pass through the above conveyance pathway of the second intermediate conveyor 3 when the metal article X is conveyed from the first intermediate conveyor 1 to the third intermediate conveyor 6.

The present disclosure is not limited to the above embodiment, and for example, the following modifications may be considered.

(1) In the above embodiment, the first unit U1, the second unit U2 and the third unit U3 are connected, but the present disclosure is not limited thereto. That is, the number of connected units, namely, the number of connected intermediate conveyors may be appropriately set according to the number of the preheating chambers and the carburizing chambers required. In addition, with regard to the connection order of units, for example, the first unit U1 and the second unit U2 may be interchanged.

(2) In the above embodiment, eight preheaters 2A to 2D and 4A to 4D, one heat equalizer 5 and four carburizers 7A to 7D are provided as the treater, but the present disclosure is not limited thereto. The number of the treaters attached to one intermediate conveyor is not limited to four or five.

(3) In the above embodiment, the preheaters 2A to 2D and 4A to 4D, the heat equalizer 5 and the carburizers 7A to 7D are provided as the treater, but the present disclosure is not limited thereto. That is, as the type of the treater, a treater that performs other treatment (main heating treatment or nitriding treatment) instead of or in addition to the preheating treatment, the heat-equalizing treatment and the carburizing treatment may be employed.

For example, the four carburizers 7A to 7D may be replaced with main heating devices that apply the main heating treatment to the metal article X. That is, instead of the four carburizers 7A to 7D, the main heating devices may be adopted as the main treaters. According to such a multi-chamber heat treatment device, it is possible to perform quenching on the metal article X. In addition, the four carburizers 7A to 7D may be replaced with nitriding devices that apply the nitriding treatment to the metal article X under a heating environment. That is, instead of the four carburizers 7A to 7D, the nitriding devices may be adopted as the main treaters. According to such a multi-chamber heat treatment device, it is possible to perform the nitriding treatment on the metal article X.

(4) In the above embodiment, each intermediate conveyor, namely, each of the first to third intermediate conveyors 1, 3 and 6 is provided with one loading port and one unloading port, but the present disclosure is not limited thereto. Each intermediate conveyer may be provided with a plurality of loading ports and/or a plurality of unloading ports for the metal article X.

That is, in the above embodiment, since each of the three first to third intermediate conveyors 1, 3 and 6 is provided with one loading port and one unloading port, the three first to third intermediate conveyors 1, 3 and 6 are connected in series. However, when each intermediate conveyor is provided with a plurality of loading ports and/or a plurality of unloading ports, it is possible to connect intermediate conveyors in a state where the conveyance pathway is branched, and to improve the degree of freedom in treatment for the metal article X.

(5) The gas cooler R is provided in the above embodiment, but the present disclosure is not limited thereto. For example, instead of the gas cooler R, a mist cooler or a dipping cooler (refer to the above second modification) may be employed. Since the gas cooler R uses the cooling gas (gas) as a refrigerant, the cooling efficiency thereof is lower than that of the mist cooler using mist such as water as a refrigerant or the dipping cooler using liquid such as oil as a refrigerant. Therefore, when higher cooling efficiency is required, the mist cooler or the dipping cooler may be used instead of the gas cooler R.

(6) The one gas cooler R (the cooler) is provided in the above embodiment, but the present disclosure is not limited thereto. That is, a plurality of coolers such as the gas cooler R, which apply the cooling treatment to the metal article X, may be provided. In addition, the plurality of coolers may be connected in series, or the cooler may be connected to each of a plurality of unloading ports provided in the intermediate conveyor.

(7) In the above embodiment, the second intermediate conveyor 3 is provided with the heat equalizer 5 (the heat-equalizing chamber), but the present disclosure is not limited thereto. The heat equalizer 5 (the heat-equalizing chamber) may be omitted as necessary. In addition, in this case, it is conceivable that the conveyance period of time from the preheaters 2A to 2D and 4A to 4D (the preheating chambers) to the carburizers 7A to 7D (the carburizing chambers) is increased by extending it and is used as heat-equalizing period of time.

(8) In the above embodiment, the second intermediate conveyor 3 is provided with the preheaters 4A to 4D (the preheating chambers), but the present disclosure is not limited thereto. For example, the preheaters 4A to 4D (the preheating chambers) may be replaced with carburizers (carburizing chambers) as necessary. That is, the treaters are configured to be attached to the intermediate conveyor with the same attachment structure (fastening structure), and thus the treater (the treatment chamber) attached to each intermediate conveyor can be replaced (interchangeable) with a different kind of treater (treatment chamber) as necessary.

(9) In the above embodiment, only the second intermediate conveyor 3 is attached with the heat equalizer 5, but the present disclosure is not limited thereto. For example, the heat equalizer 5 may be attached to the first intermediate conveyor 1 and/or the third intermediate conveyor 6 instead of the second intermediate conveyor 3, or the heat equalizer 5 may be attached to the first intermediate conveyor 1 and/or the third intermediate conveyor 6 in addition to the second intermediate conveyor 3.

(10) In the above embodiment, the treater is provided on the upper side of the intermediate conveyor, but the present disclosure is not limited thereto. For example, the four preheaters 2A to 2D may be provided on the lower side of the first intermediate conveyor 1, the four preheaters 4A to 4D and the heat equalizer 5 may be provided on the lower side of the second intermediate conveyor 3, and the four carburizers 7A to 7D may be provided on the lower side of the third intermediate conveyor 6.

(11) The metal article X may be manufactured by, for example, cutting work before the heat treatment is performed by the multi-chamber heat treatment device of the present disclosure. Since cutting oil or chips may be attached to the metal article X after the cutting work, it is preferable to remove the cutting oil or the like from the metal article X for appropriate heat treatment. Therefore, for example, the preheaters 2A and 2B in the vicinity of the loading port 1*a* of the first unit U1, namely, the treater on the most upstream side of the multi-chamber heat treatment device of the present disclosure may be replaced with a washer, and after the metal article X is cleaned by the washer, the metal article X may be conveyed to the preheater on the downstream side and be preheated. In addition, all of the treaters of the first unit U1 may be washers. That is, the intermediate conveyor of the present disclosure may be attached with the washer for washing the metal article X before the preheating treatment.

What is claimed is:

1. A multi-chamber heat treatment device comprising:

intermediate conveyors connected together, wherein each intermediate conveyor of the intermediate conveyors is attached with a treater that applies predetermined heat treatment to a treatment object and conveys the treatment object to the treater, wherein the treater of a last intermediate conveyor of the intermediate conveyors in a conveyance pathway for the treatment object includes a plurality of main treaters and a cooler, the plurality of main treaters include main treatment chambers that apply main treatment to the treatment object, the cooler includes a cooling chamber that applies cooling treatment to the treatment object after the main treatment, and the main treatment chambers and the cooling chamber are attached to the last intermediate conveyor, wherein the treater of an intermediate conveyor other than the last intermediate conveyor of the intermediate conveyors includes a plurality of preheaters, the plurality of preheaters include preheating chambers that apply preheating treatment to the treatment object before the main treatment, and the preheating chambers are attached to the intermediate conveyor other than the last intermediate conveyor, wherein the preheating chambers are disposed such that travel distances or travel periods of time of the treatment object to the main treatment chambers are equal to each other, and wherein the main treatment chambers are disposed such that travel distances or travel periods of time of the treatment object to the cooling chamber are equal to each other.

2. The multi-chamber heat treatment device according to claim 1, wherein the intermediate conveyor other than the last intermediate conveyor is attached with a heat-equalizing chamber of a heat equalizer, and the heat-equalizing chamber applies heat-equalizing treatment to the treatment object after the preheating treatment.

3. The multi-chamber heat treatment device according to claim 1, wherein one of the intermediate conveyors is provided with a plurality of loading ports and/or a plurality of unloading ports for the treatment object.

4. The multi-chamber heat treatment device according to claim 1, wherein the treater of one of the intermediate conveyors is attachable and detachable to and from the one of the intermediate conveyors.

5. The multi-chamber heat treatment device according to claim 1, wherein at least one treater is interchangeable with a different kind of treater.

6. The multi-chamber heat treatment device according to claim 1, wherein in a conveyance pathway to the treater of one of the intermediate conveyors, another treater is disposed, and the one of the intermediate conveyors is configured to convey the treatment object to each of the treater and the another treater via the conveyance pathway.

7. The multi-chamber heat treatment device according to claim 1, wherein the intermediate conveyors are linearly disposed in plan view.

* * * * *